United States Patent [19]

Weir

[11] Patent Number: 4,967,495

[45] Date of Patent: Nov. 6, 1990

[54] VACUUM FEED SYSTEM FOR FEEDING LAUNDRY ARTICLES ONTO A CONVEYOR

[76] Inventor: Henry J. Weir, The Willows, Woodcroft, Chepstow, Gwent, United Kingdom

[21] Appl. No.: 361,150

[22] Filed: Jun. 5, 1989

[30] Foreign Application Priority Data

Jun. 3, 1988 [GB] United Kingdom ..... 8813110

[51] Int. Cl.[5] ..... D06F 67/04

[52] U.S. Cl. ..... 38/143; 38/8

[58] Field of Search ..... 271/276; 38/143, 8; 406/77, 78, 79, 82

[56] References Cited

U.S. PATENT DOCUMENTS

| | | | |
|---|---|---|---|
| 3,386,192 | 6/1968 | Fornaciari | 38/143 |
| 3,414,997 | 12/1968 | Henry | 38/143 |
| 3,436,853 | 4/1969 | Buss | 38/143 |
| 3,483,645 | 12/1969 | Gilmore | 38/143 |
| 3,657,382 | 4/1972 | Valentine | 38/143 |
| 3,909,964 | 10/1985 | Wenck | 38/143 |
| 4,729,181 | 3/1988 | Weir | 38/143 |

FOREIGN PATENT DOCUMENTS

| | | |
|---|---|---|
| 0093365 | 4/1983 | European Pat. Off. . |
| 0107311 | 8/1983 | European Pat. Off. . |
| 0153069 | 1/1985 | European Pat. Off. . |
| 0241176 | 3/1987 | European Pat. Off. . |
| 1151434 | 8/1966 | United Kingdom . |

*Primary Examiner*—Andrew M. Falik

*Attorney, Agent, or Firm*—Wallenstein, Wagner & Hattis, Ltd.

[57] ABSTRACT

A feed system for conveying and spreading laundry articles on a conveyor has an air-permeable conveyor having a feed end upon which leading portions of an article are placed for conveyance therefrom. Varying portions of the article to be so emplaced are supported by a feed support element spaced at a distance from the feed end of the conveyor to provide a gap therebetween. A suction duct located generally below the feed end of the conveyor and the feed support element causes air to flow through the feed end of the conveyor to adhere the leading part of the article to the conveyor, and through the space between the feed end of the conveyor and the support element to draw the trailing portion of the article down into a suction duct to stream the article therein by air flow on both sides. An enclosure surrounding the feed end of the conveyor and has a moveable closure member sealing the entrance thereto. After emplacement of the article against the closure member, opening of the closure member causes external air to be drawn into the suction system, carrying the article along with it to place the leading part thereof on the feed conveyor and drawing the trailing end of the article into the duct.

42 Claims, 17 Drawing Sheets

VACUUM FEED SYSTEM FOR FEEDING LAUNDRY ARTICLES ONTO A CONVEYOR

TECHNICAL FIELD

The technical field of the inventions is laundry feeding machinery and handling machinery.

BACKGROUND OF INVENTION

This invention relates to feed mechanisms for feeding laundry articles to laundry equipment for subsequent processing such as ironing machines, folding machines or the like. The expression "laundry article" is intended to encompass fabric articles such as sheets, pillow cases, towels, blankets and articles of clothing processed in laundries.

My U.S. Pat. No. 4,729,181 discloses a laundry feeding machine having a conveyor on which articles are fed after being held by a suction holding device at the front of the conveyor. Simultaneously with the release of the article from the suction holding device, suction is applied in the tunnel enclosing the conveyor, and this draws the leading part of the article onto the conveyor. The overall speed of operation of the machine is determined by the speed at which the valves controlling the suction applied to the holding device and the conveyor can be switched on and off and suction thus established at the respective zones.

It would be desirable to provide a more rapid operation than that which can be achieved with the disclosed machine, and it would also be desirable to reduce the complexity of the machine and thereby reduce its costs. This is particularly so in the case of multi-lane versions of the machine in which a wide conveyor has a row of said suction/holding devices by removable partitions spaced apart across the entry of the machine to be sued collectively (by linking all or certain of the devices together or individually) according to the width of the articles to be fed. This arrangement with the individual valve mechanisms for each suction/holding device and the need to isolate the vacuum applied to each of the suction/holding devices makes the machine as a whole unduly complex.

Frequently a long duct or streaming chamber is provided between the suction source and the entry passage of a feeding machine so that when the leading edge of a flat laundry article such as a sheet is emplaced on the conveyor, the trailing portion is drawn by suction into this elongated duct to be streamed out therein. Such ducts are typically configured to have relatively closely spaced major confronting walls and the opposite major faces of the streamed article are confronting the interior faces of these major walls. Conventional ducting arrangements do not provide for high speed air flow along both of the major faces of the article. This occurs in prior art designs because that portion of the article placed on the conveyor effectively blocks the flow of air from that portion into the duct, with the result that high speed air only flows through that portion of the duct closest t the operator, and thus does not provide optimal smoothing.

SUMMARY OF INVENTION

In accordance with one of the features of the invention where only one overall vacuum chamber is needed in any case, a feed mechanism is provided for laundry articles comprising an endless conveyor through which air can pass and having a feed end to receive articles onto the conveyor and a delivery end for delivering articles to further laundry equipment. However, the conveyor need not have air drawn therethrough. An enclosure is provided for the feed end of the conveyor, the enclosure having an inlet opening onto the feed end of the conveyor and an outlet for articles carried by the conveyor. One and preferably a number of horizontally spaced closure members are provided for the inlet for temporarily holding articles suspended in front of the inlet of the enclosure. Means for retracting the one or more closure members from the inlet are provided over the feed end of the conveyor. Means are provided for evacuating air (e.g., continuously) from the enclosure below the conveyor to create an air flow both preferably through the conveyor and into the inlet whereby retraction of the closure member causes the upper part of the article to be drawn into the enclosure onto the conveyor, which draws the article through the enclosure to the delivery end of the conveyor. In contrast with the machine disclosed in the previously mentioned U.S. Pat. No. 4,729,181, the movement of the article towards the conveyor begins with the initial phases of inward movement of the one or more closure members, each typically configured as a top-hinged door. In this previously mentioned patent a valving member of similar dimension must travel through its full movement merely to release the suction holding the article, after which time the article drops a short distance, thereafter to be pulled into the machine. This aspect of the present invention thus significantly reduces cycle time.

In accordance with another feature of the invention, not requiring the previously mentioned closure members, but preferably used therewith, the enclosure may have an air duct extending for the full width of the conveyor below the forward end thereof and having a convergent mouth located immediately below the forward end of the conveyor and leading to a narrow parallel sided streaming duct portion extending generally downwardly from the convergent mouth to a chamber to which said air evacuating means are connected to evacuate air from the enclosure. The conveyor includes preferably a number of spaced apart apertured endless belts allowing the passage of air therebetween and therethrough. After a leading part of an article is placed on the conveyor, the trailing part is drawn by the air flow into the duct. Air drawn through the conveyor portion ahead of a leading edge of the article is drawn into the streaming duct on the rear surface of the trailing part of the article, and the air from the vicinity of the feed end of the conveyor and forwardly thereof flows into the streaming duct portion along the front major surface of the article, and the article is then extracted from the duct as the conveyor advances the article through the enclosure. The air flow through the duct assists in drawing out and smoothing the article as it is drawn on to the conveyor, and the article is held in place on the conveyor by means of suction applied through the conveyor.

The use of an air-permeable set of conveyor belts, preferably apertured, allows successful adhesion of a relatively small leading portion of the article. This in turn allows a relatively large trailing portion to be streamed and smoothed. Additionally a substantial portion of the conveyor beyond the article is exposed, to permit unobstructed air flow from this region down into the duct.

Other features and advantages of the invention will become apparent upon making reference to the specification, claims and drawings to follow.

DESCRIPTION OF THE INVENTION

Figure 1:
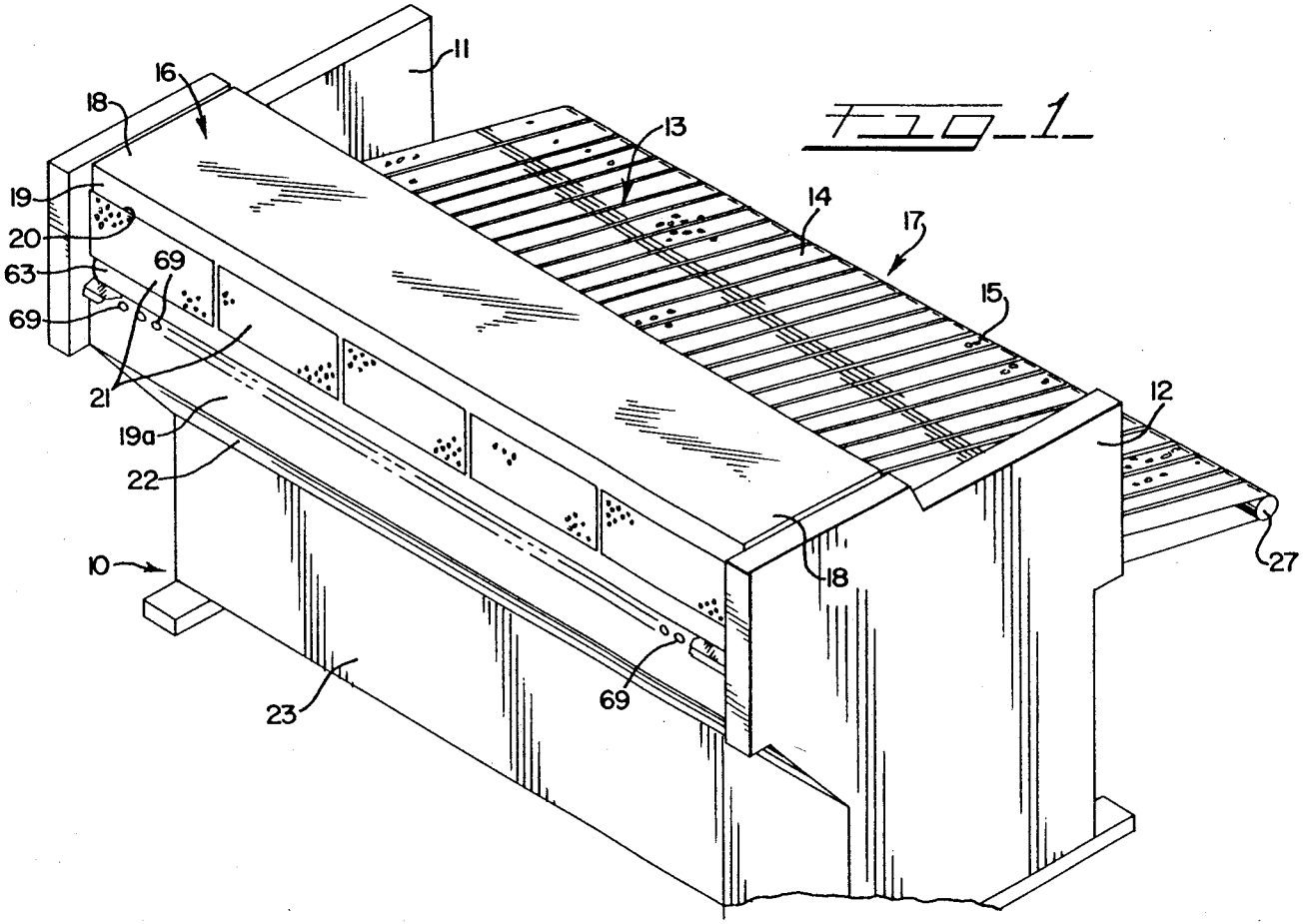
FIG. 1 is a partially cutaway perspective view of a feed mechanism for feeding laundry articles to further laundry equipment.
Figure 2:
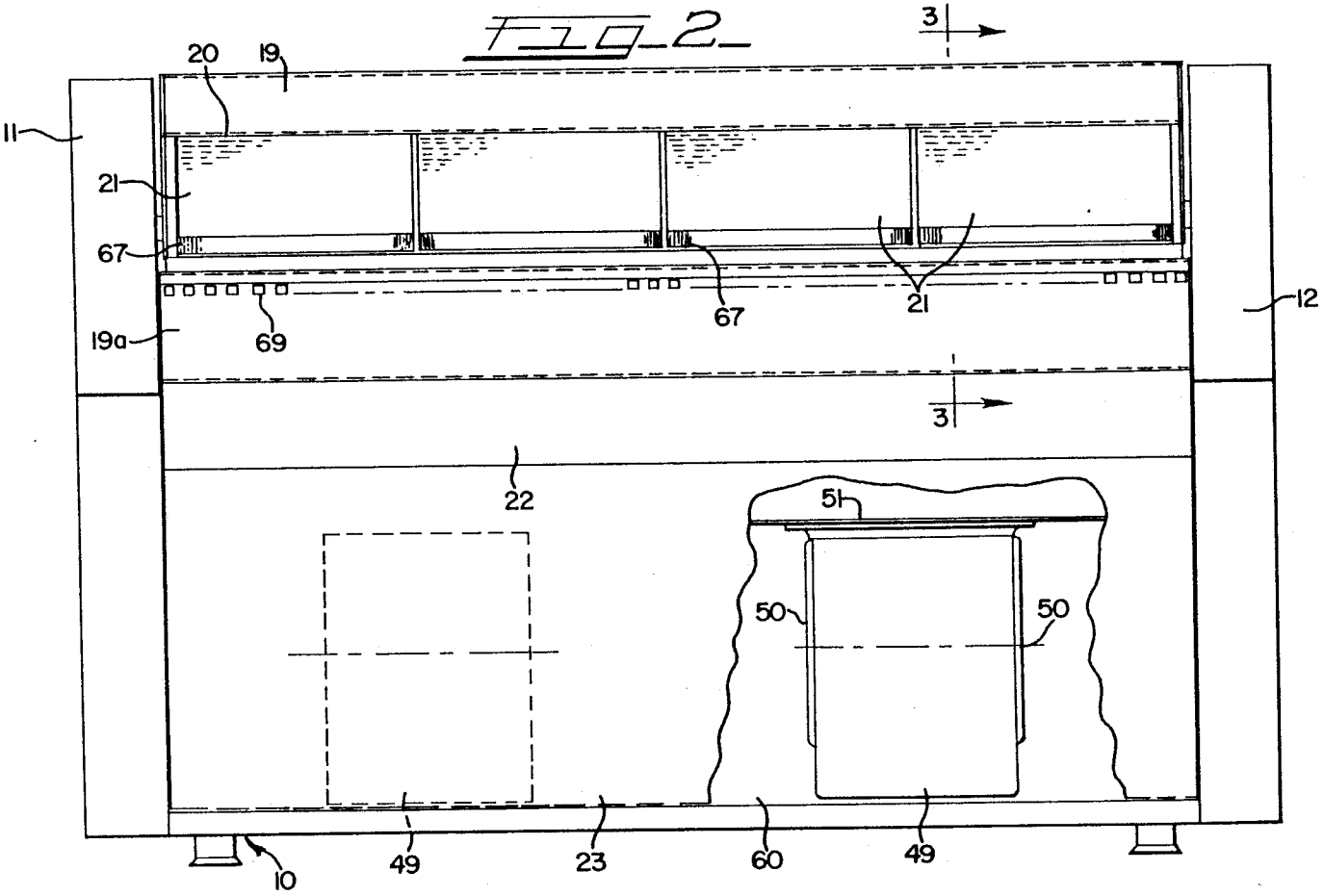
FIG. 2 is a front elevation view of the feed mechanism.

The drawings illustrate a number of manually loaded feed mechanisms for feeding laundry articles such as sheets, pillow cases, towels, blankets and the like at high speed and in quick succession to laundry processing equipment such as ironers, folders or other like equipment. Reference will be made firstly to the embodiment of the feed mechanism illustrated in FIGS. 1 to 12 of the drawings.

The feed mechanism comprises a base structure 10, on which an upstanding pair of side walls 11, 12 are mounted and between which a wide generally horizontally extending conveyor mechanism 13 is mounted. The conveyor mechanism comprises a multiplicity of narrow closely spaced bands 14 each formed with a multiplicity of perforations 15 to allow the passage of air as described later. The conveyor mechanism has a forward (feed) end which is contained in an enclosure indicated generally as 16 between the side walls and a rearward (delivery) end indicated generally as portion 17 of the conveyor projecting from between the side walls and, in use, is aligned with the inlet to the ironer, folder or other laundry equipment which the mechanism is to feed.

The enclosure 16 comprises a top wall 18 extending between the side walls 11, 12 and formed with a downturned front wall 19. The front wall 19 has an elongated inlet opening 20 which extends the full width of the feed mechanism and a plurality of rectangular closure members 21 (five in the arrangement illustrated) are mounted side by side along the inlet for individual or collective opening of the inlet as described later. The front wall 19 continues below the inlet in a continuation portion 19*a* which terminates in a downwardly and forwardly angle underside 22 (FIG. 1) to form an overhang and which terminates in a vertical wall 23. As will be described later, the operator stands in front of the front wall 19 of the machine and a supply of laundry articles to be processed can be stored or fed to the space underneath the overhanging part of the enclosure for convenient pick up by the operator.

The closure members 21 for the inlet port 20 effectively divide the feed mechanism into a plurality of similar lanes, one for each closure member and reference will now be made to FIGS. 3 and 5 of the accompanying drawings which are sectional views through one such lane showing the internal construction of the feed mechanism in greater detail.

As indicated earlier, the conveyor comprises a plurality of inlet flexible perforated belts 15 which extend around a number of spaced horizontally extending rollers mounted in bearings on the side walls 11, 12. A first roller 24 is disposed generally centrally in the enclosure 16 around which the belts pass in the direction of the arrows and defining a forward feed end of the conveyor. The belts then pass up a shallow incline towards the rear of the enclosure 16 over a roller 25 where they emerge from the enclosure and pass down a shallow incline over a roller 26 to an outer end roller 27 (see FIG. 1) mounted in cantilever manner out from the side walls 11, 12. The roller 27 defines the delivery end 17 of the conveyor and the belts then pass back over a roller 28 disposed below roller 26 and back into the rear of the enclosure and then around the roller 24.

As will be described in greater detail below, air is evacuated from the enclosure 16, and to restrict ingress of air at the back of the enclosure a further floating roller 29 is mounted to bear on the conveyor above roller 25 and a flexible sealing strip 30 bears on the upper side of roller 29, the sealing strip being mounted on a bracket 31 secured to the box form structure 32 constituting the top 18 of the enclosure. The enclosure 16 has a lower back wall 34 terminating in a cross member 35 over which the lower stretch of the conveyor 15 runs. An elongated bracket 36 is secured to the cross member 35 at spaced locations to form a narrow slit between the two through which the belts of the conveyor can pass and a sealing strip 37 is secured to the top face of the bracket to bear on the underside of roller 25.

Figure 3:
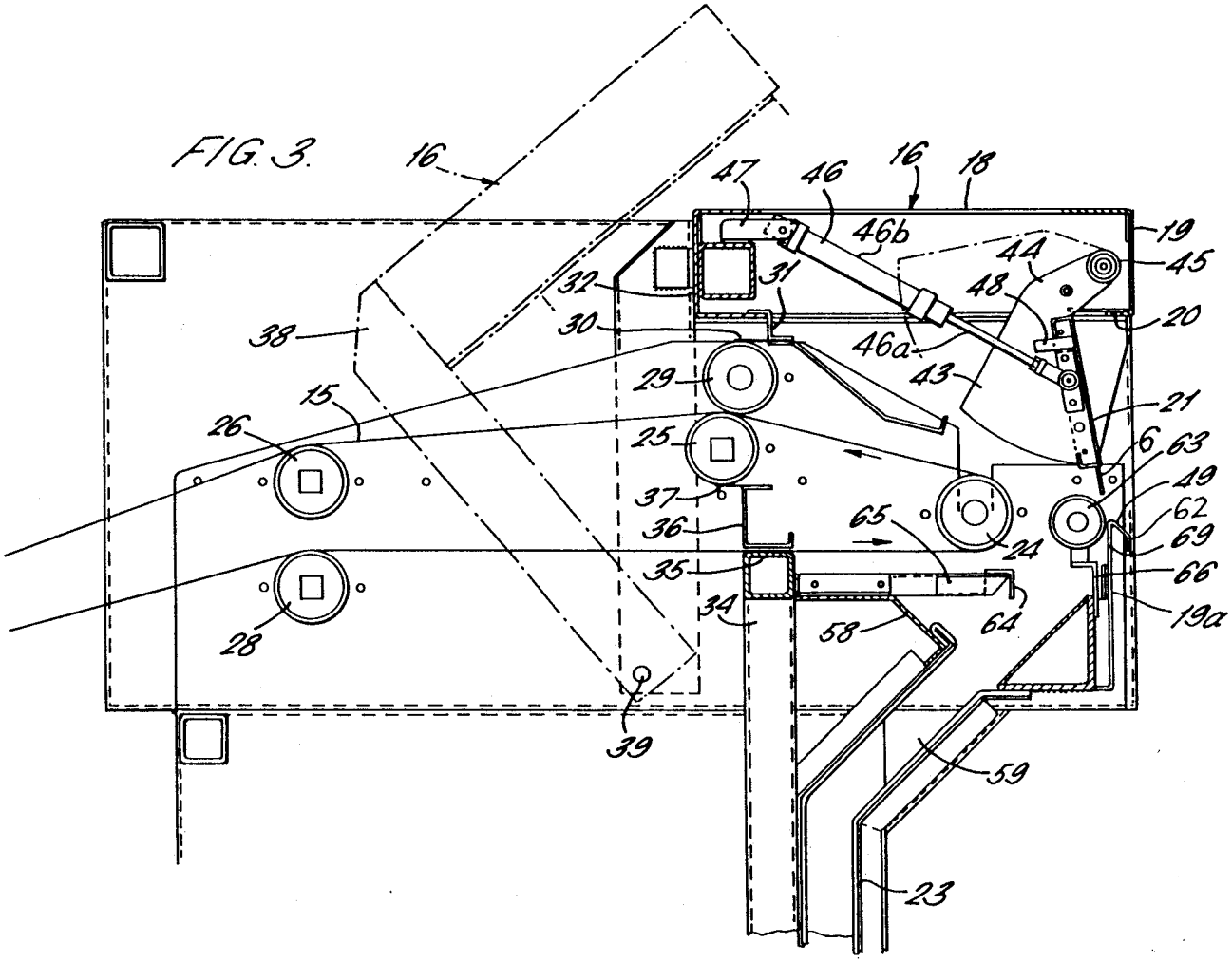
FIG. 3 is a side sectional view through the upper part of the feed mechanism along cut lines 3—3 in FIG. 2 showing the construction in greater detail.
Figure 4:
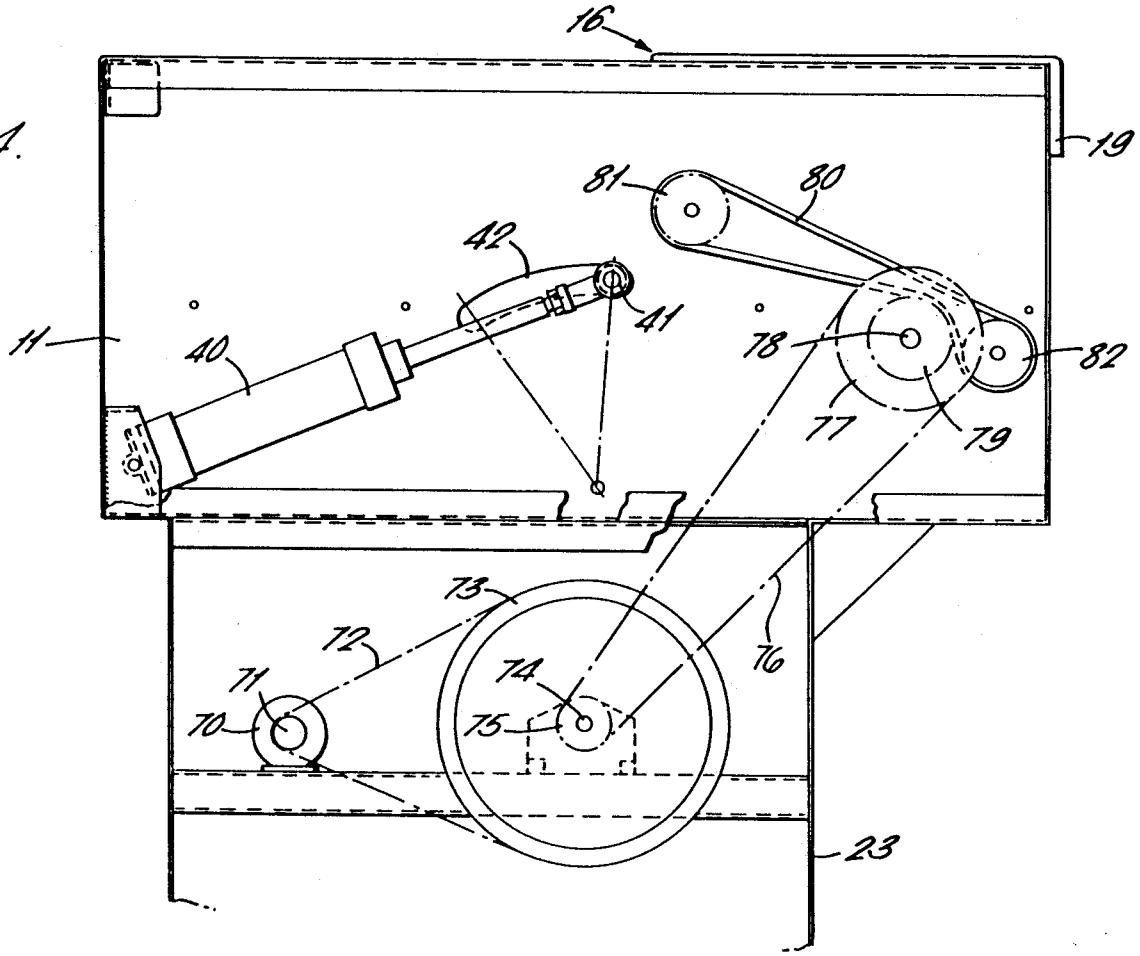
FIG. 4 is a side view of the feed mechanism illustrating the drive means.

As best shown in FIG. 3, the top of the enclosure 16 is formed as a box section extending the width of the feed mechanism, and is mounted at the rear of the enclosure on upstanding arms 38 pivoted at their lower ends on pivot pins 39 secured to the side walls 11, 12. The top wall 32 can be raised about the pivot axis 39 to expose the forward end of the conveyor by means of a double acting pneumatic ram 40 mounted on the outer side of side wall 11 as shown in FIG. 4 and connected through a pin 41 to one of the members 38 acting through an arcuate slot 42 in the side wall.

Figure 5:
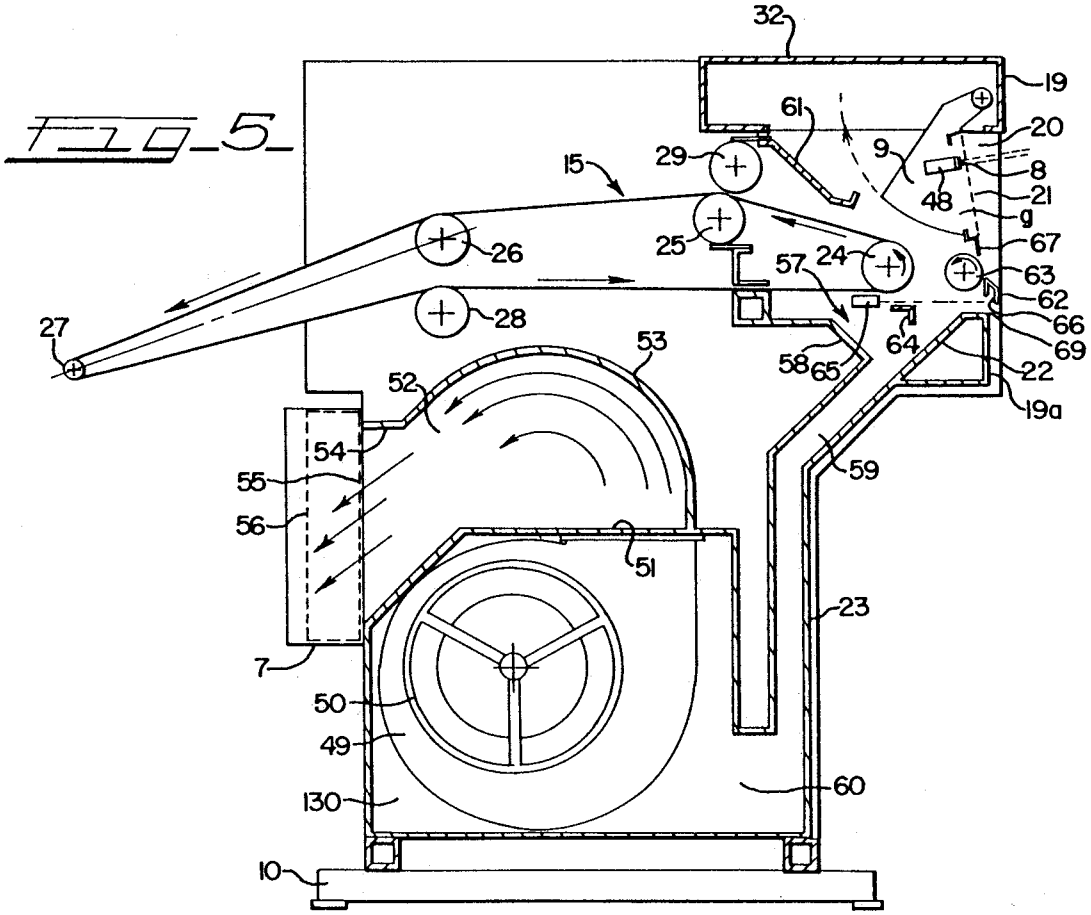
FIG. 5 is a diagrammatic side sectional view showing the feed mechanism in section with an inlet to the feed mechanism closed.

Referring now to FIGS. 3 and 5, the closure members 21 for the inlet 20 in the front wall of the enclosure comprise rectangular plates formed with a multiplicity of small perforations 9 (FIG. 5). The plates are mounted on side sheets 43 having upwardly extending cranked arms 44 mounted on pivots 45 secured in the top wall member 32 to permit the front wall to swing about a horizontal axis extending along the top wall. Each closure member 21 is rotated between the position as shown in FIG. 3 in which the inlet 20 is closed and the open position shown in FIG. 10 by an individual double acting pneumatic ram device 46 connected to one cheek 43 of the closure member and whose cylinder **46*b* into which the arm is drawn is connected to a support bracket 47 at the rear of the top member 32. The ram has a valve controlled air supply for retracting to swing the closure member 21 in the opening direction and to extend to return the closure member to the inlet closing position as will be described later. A photo-electric proximity sensor 48 is mounted on the inside of the closure member 21 to direct a beam of light outwardly from the sensor through an aperture 8 (FIG. 5) in the closure member 21. When an upper edge of an article to be fed by the mechanism is laid on the plate 21 over the sensor, the interruption of the light beam triggers the sensor 48 to send a signal to a microprocessor controlled mechanism for the feed mechanism again to be described later. The sensor 48 is positioned at a predetermined position above the lower edge of plate 21** to ensure that a sufficient length of the article is laid on the plate for transfer to the feed end of the conveyor, and guide lines may be marked on the plate to assist the operator in aligning the sheet or other article edge on the plate.

As shown in FIG. 5, the lower part of the mechanism is formed with a large chamber 30 extending the width of the mechanism between the side walls 11, 12 in which two centrifugal fans 49 are mounted at spaced apart locations each having dual axial inlets 50 and an upwardly directed outlet 51. The outlets 51 discharge into a further chamber 52 extending the width of the feed mechanism and have a curved upper wall 53 which directs aIr flow from the outlets 51 to a rectangular exhaust aperture 54 extending the full width of the feed mechanism. The exhaust aperture 54 is covered by an elongate box form baffle structure 7 comprising parallel perforated plates 55, 56 through which air delivered by the fans is forced to pass to disperse the concentrated air steams from the fans.

The lower part of the enclosure 16 is formed with a convergent mouth 57 one side of which is formed by the angled underside 22 and the other side of which is formed by an internal wall 58, the mouth extending the full width of the mechanism between the side walls. The convergent mount 57 leads into a narrow parallel sided duct 59 on the inside of wall 22 and lower wall 23 to open at 60 into the chamber 48 so that the fans 49 draw air from the enclosure 16 and create a region of low pressure in the enclosure. The region of low pressure is illustrated by shading in FIG. 6 in which the air flows into and down the enclosure into the duct 59 are also indicated by arrows.

Figure 6:
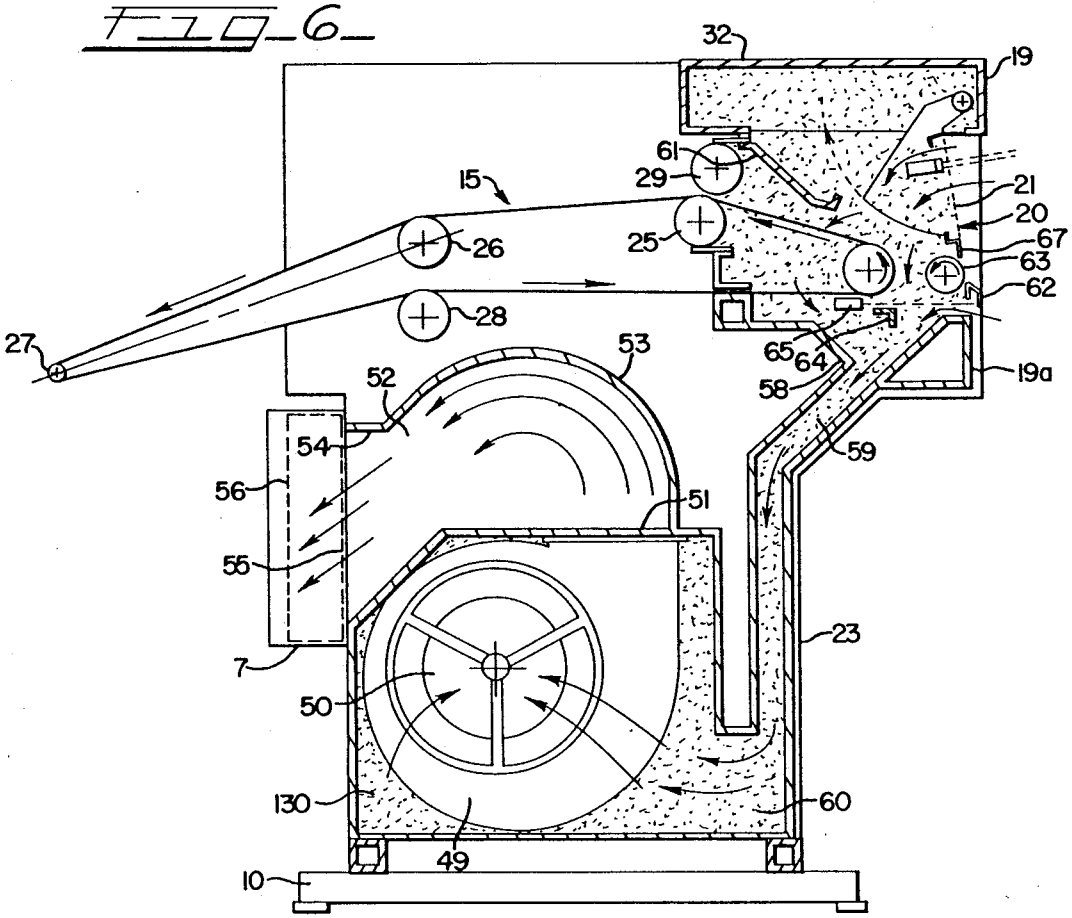
FIG. 6 is a similar view to FIG. 5 showing low pressure regions of the feed mechanism from which air is evacuated as shaded.
Figure 7:
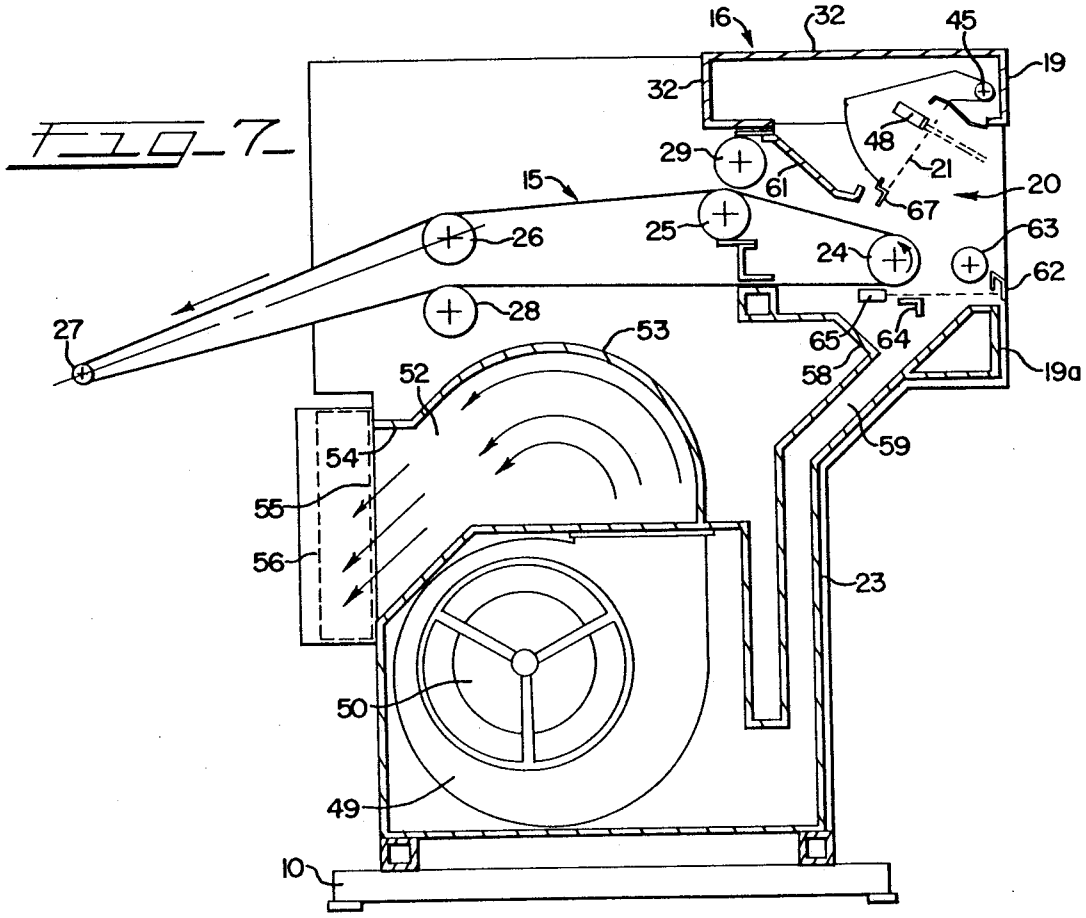
FIG. 7 is a similar view to FIG. 5 with the inlet to the feed mechanism open.

The fans are run continuously while the feed mechanism is in operation so that a constant low pressure zone is created in the enclosure 16. The lower pressure region behind the closure member 21 creates suction at the apertures in the closure member so that when a leading edge of a or other article to be fed by the mechanism is laid on the closure member 21 it adheres to the closure member. The photo-electric sensor 48 detects the presence of the sheet and initiates retraction of the ram 46 once the previously fed sheet has cleared the duct 59, as will be described below. The closure member 21 is retracted through the arcuate path indicated in FIG. 5 over the forward feed end of the conveyor 15. A baffle plate 61 is mounted on the underside of the top member 32 of the enclosure towards the rear thereof and extends forwardly above the forward end of the conveyor to concentrate air flow drawn into mouth 57 by duct 59 through the front part of the conveyor as indicated in FIG. 6.

Referring now particularly to FIGS. 9–12, laundry articles such as sheets to be fed by the mechanism are laid with a leading edge of the sheet or other article on closure member 21 or, in the case of a wide article, a plurality of closure members 21 arranged to operate collectively by manual operation of a suitable switching means (not shown) which selectively gang a member of the pneumatic ram devices for operation. Individual valve (not shown) are operated to direct pressurized air to the cylinders of the one or more operative pneumatic ram devices involved. The photo-electric sensor 48 of each closure member detects the presence of the article and initiates retraction of the operative pneumatic ram device arms **46*a* into the cylinder 46*b* to swing the closure member 21 involved upwardly. As the closure member sweeps upwardly and over the forward end of the conveyor 15, air flow through the forward end of the conveyor draws the leading part of the sheet from the closure member 21** onto the conveyor which then commences to draw the sheet through the inlet into the enclosure.

The upper edge of front wall portion **19*a* defining the lower boundary of inlet 20 is formed with a downwardly and outwardly angled edge formation extending the length of the inlet and terminating in a smoothing edge 62 over which the trailing part of the sheet passes as it is drawn into the enclosure to assist in removing creases and wrinkles from the sheet. A driven roller 63 is mounted in the enclosure along the lower edge of opening 20 immediately adjacent the smoothing edge 62, the roller 63 being driven through a belt drive mechanism which also drives the conveyor as will be described later. The roller 63 is rotated by roller drive means 131** in a direction so that its upper periphery moves inwardly with respect to the enclosure and at high speed to draw the sheet into the enclosure. The roller has a suitably roughened surface for this purpose. Also the drive mechanism for the roller may include a friction clutch so that if the roller is impeded of any reason, it ceases to rotate.

Referring also to FIGS. 9–12, the powerful suction created in the mouth 57 and duct 59 by fans 49 draws the trailing part of the sheet assisted by the roller 63 into the duct 59 and the rapid air flow past either major face of the sheet, assists in smoothing the sheet particularly as the sheet is drawn from the duct by the conveyor 15. As indicated by the arrows in FIG. 6, air is drawn into the duct both along wall 22 and through the conveyor and down the inner wall 58 so that air flow is established on both major faces of the sheet to assist in smoothing the sheets. A further smoothing edge 64 is mounted in the mouth of the duct immediately below the forward end of the conveyor and over which the trailing edge of the sheet passes as it is drawn from the duct again to assist in smoothing the sheet.

A separate second photo-electric device 65 associated with each station is directed at a reflector 66, (FIG. 3) mounted on the inside of front wall portion **19*a*. Each photo-electric device 65 is connected to the aforesaid microprocessor controlled system for the feed mechanism to inhibit operation of the associated pneumatic ram device 46 to prevent a further sheet to enter the enclosure while the beam between each device 65 and reflector 66 is interrupted by the presence of a sheet extending into the duct 59. Once the sheet has been withdrawn from the duct, and after a dwell period has elapsed determined by the microprocessor mechanism, the pneumatic ram device 46 involved is retracted to admit the leading part of the next sheet onto the front end of the conveyor so that a more or less continuous stream of sheets is laid on the conveyor. The lower of each closure member 21 carries a 67 (FIG. 5) which forms both an air sea closes the gap between the closure and roller 63** to prevent fingers inadvertently entering the enclosure.

The drive mechanism for the conveyor rollers is shown in FIG. 4. The drive mechanism is located on the outer side of side wall 11 and comprises an electric motor 70 having a drive pulley 71 connected by a belt drive 72 to a large driven wheel 73 on a shaft 74. The shaft 74 also carries a small drive wheel 75 connected by a belt drive 76 to a pulley 77 connected to the end of shaft 78 on which conveyor roller 24 is mounted to drive the conveyor. The shaft carries a further drive wheel 79 which drives a further drive belt 80 around pulleys 81 and 82 in the reverse direction. Pulley 81 is connected to top roller 29 and pulley 82 is an idler pulley. The drive for roller 63 is taken from the other end of shaft 78 and is geared up in a ratio of 4:1 through a further belt drive.

Figure 9:
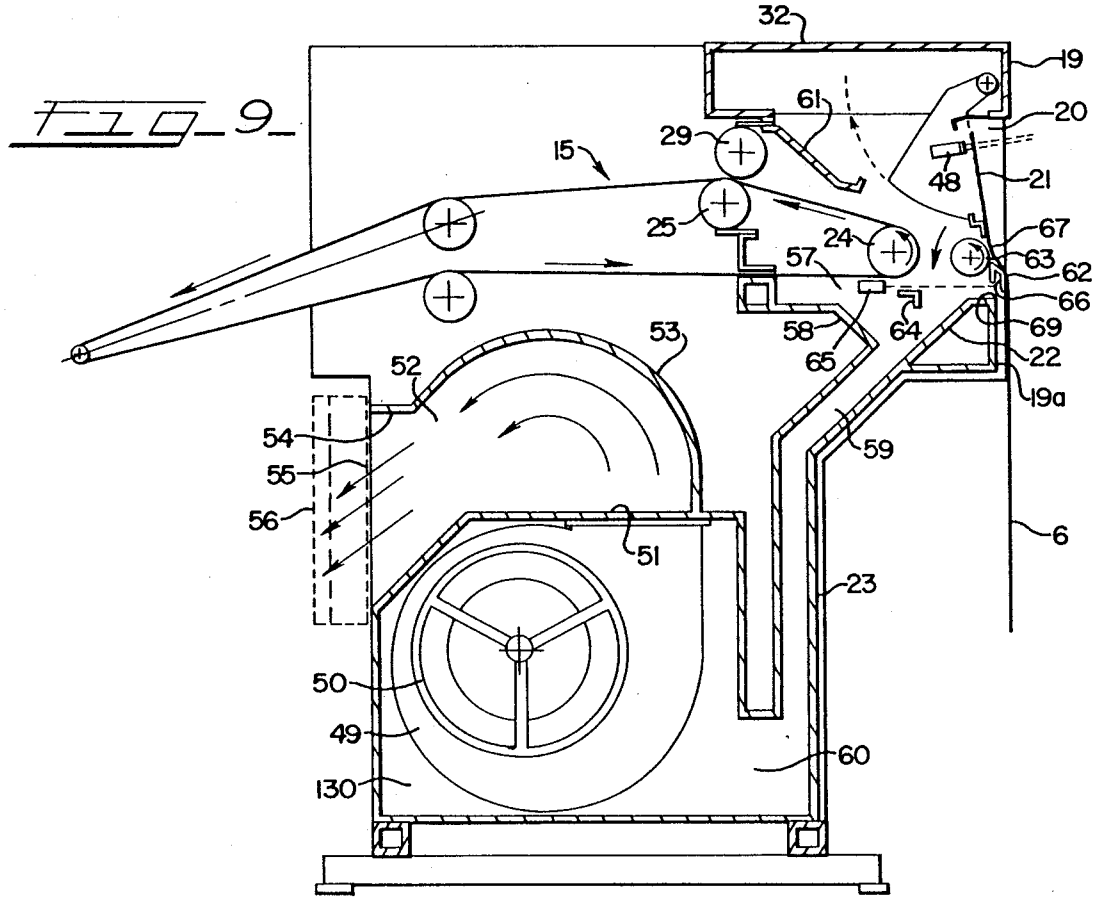
FIGS. 9 to 12 are similar views to FIG. 5 showing the sequence of steps of article travel in the feeding mechanism.
Figure 10:
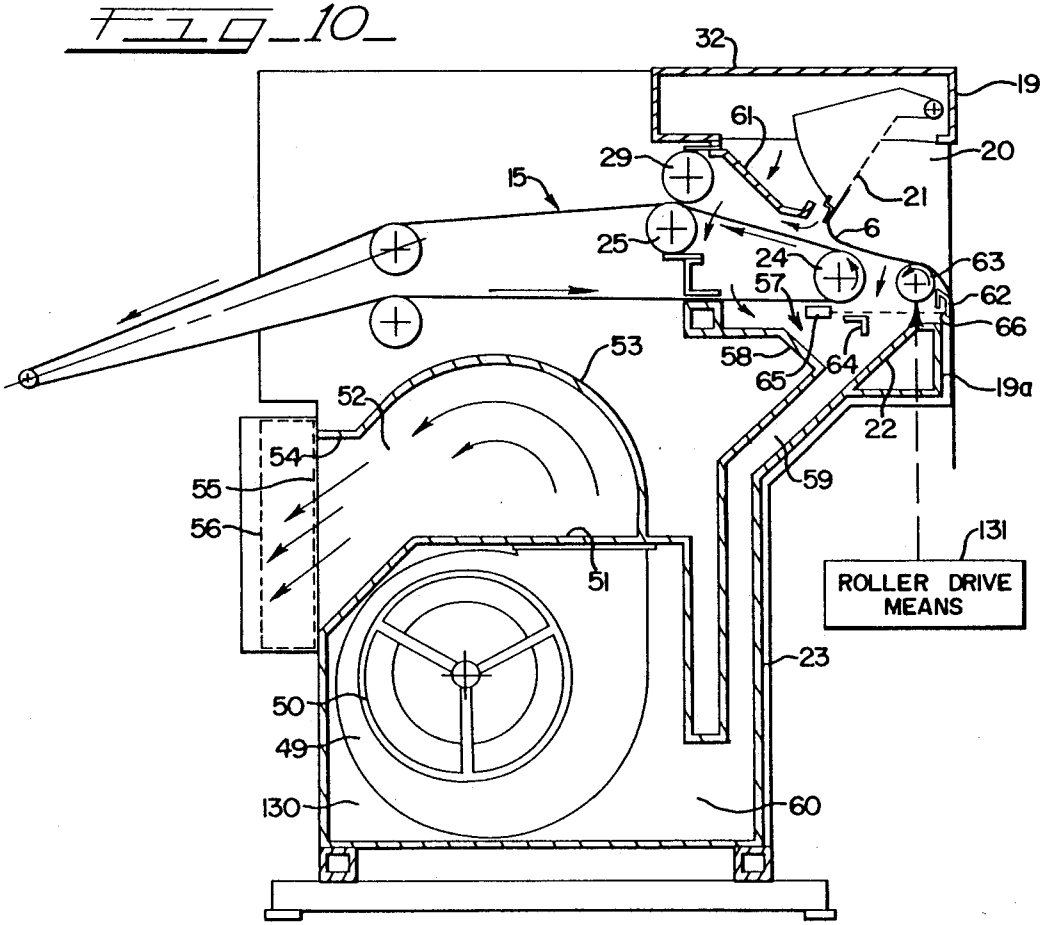
Figure 11:
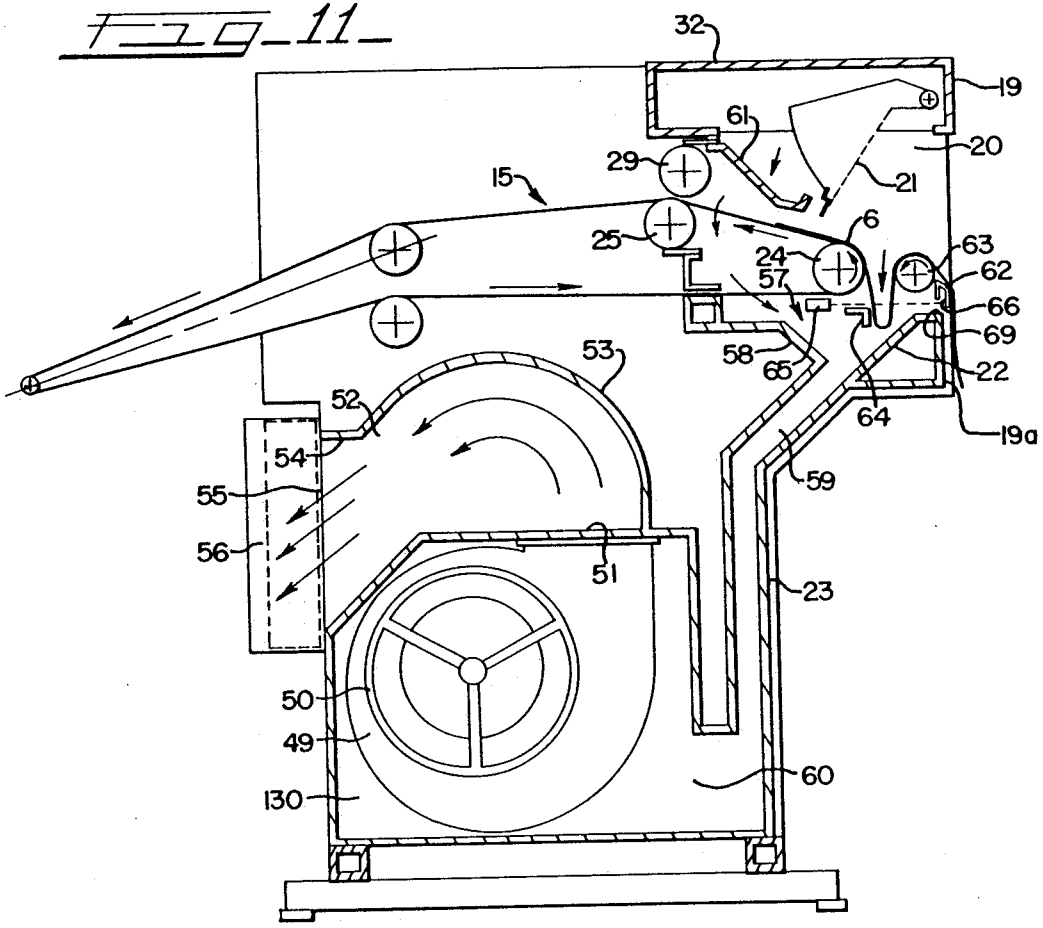
Figure 12:
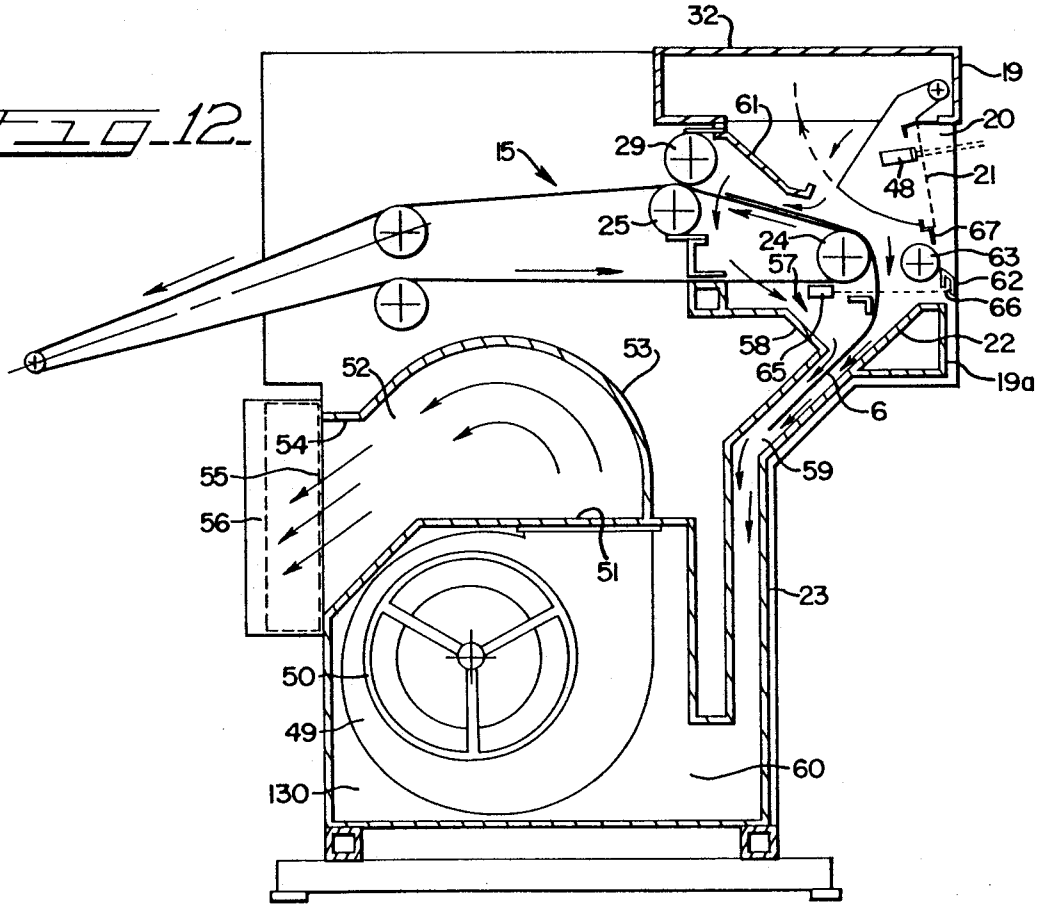

FIGS. 9 to 12 depict schematically the sequence of steps in a feeding operation. In FIG. 9 a sheet 6 has been laid against the closure member 21. In FIG. 10, the plate 21 has retracted to transfer the leading edge of the sheet 6 to the forward end of the conveyor by the air flow drawn through the conveyor. In FIG. 11, the trailing part of the sheet is being drawn into the air duct assisted by roller 63. In FIG. 12, the sheet is being drawn out of the air duct against an air flow on either major face to smooth the sheet as it is drawn on to the conveyor.

Figure 8:
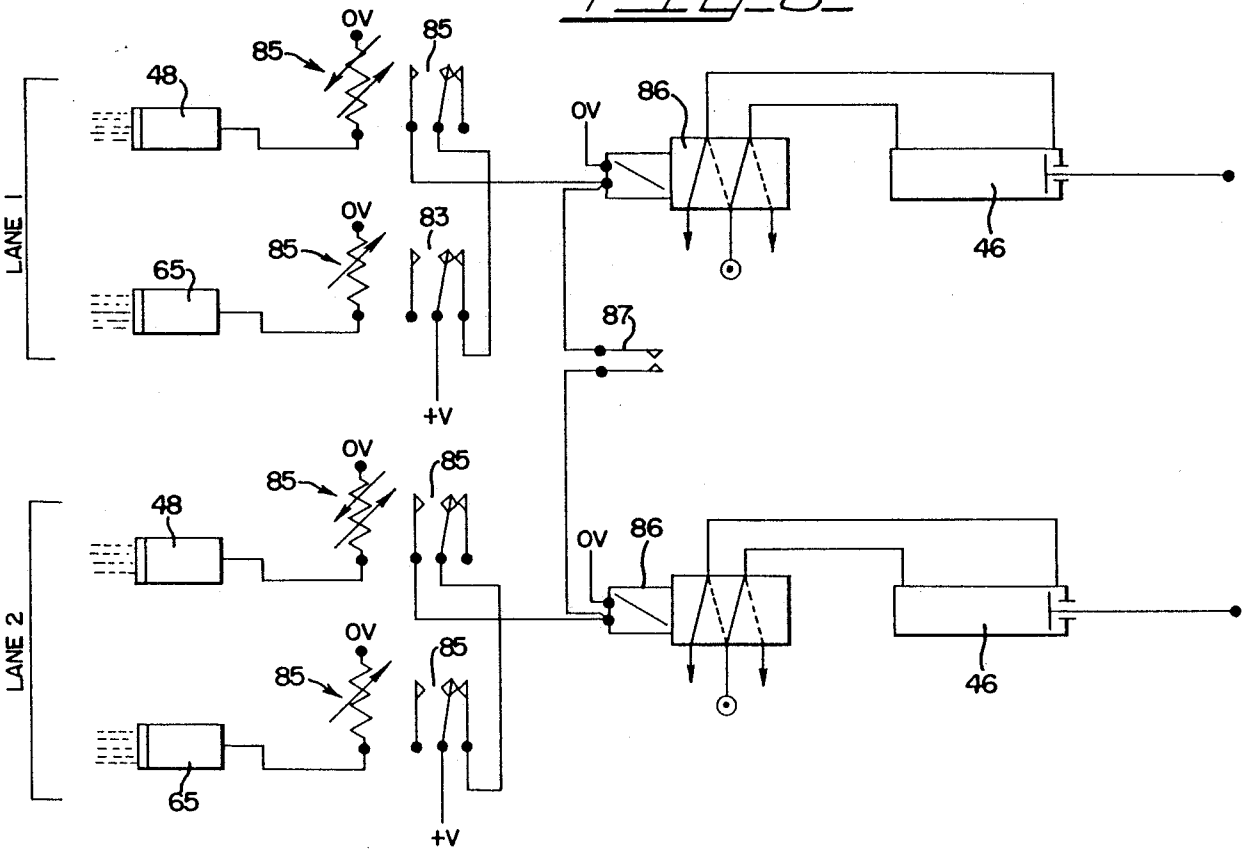
FIG. 8 is an electro-pneumatic circuit diagram for a control system for the mechanism.

FIG. 8 illustrates the basic electro-pneumatic circuit for a two lane operation of the above-described feed mechanism. The photo-sensors on the closure members are illustrated at 48 and the photo-sensors directed across the mouth of the duct are indicated at 65. Devices 85 are electronic time delay relays with adjustable delays both "on" and "off" . These short delays are adjusted to provide:

i. The operator time to place articles onto the closure members;

ii. The duration time for mechanical operations prior-to circuit resetting)

iii. A delay time just sufficient to allow the clearance of a first article onto the conveyor prior to introducing a second article by opening of the closure member. This adjustment will enable articles to be fed edge to edge for maximum productivity.

Items 86 are individual solenoid operated pneumatic valves for controlling extension and retraction of the individual pneumatic cylinders 46 for the closure members 21. The solenoid operated valves 86 can be interconnected by switch 87 to enable individual operation of the closure members or collective operation of closure members according to the width of the sheet to be fed.

As indicated earlier covering of photo-electric sensor 48 by the leading edge of a sheet causes its associated switch 85 to energize solenoid valve 86 to cause ram 46 to retract. When solenoid valve 82 is deenergized, the valve reverses air flow to ram 46 extending the ram to return plate 21 to the closed position. In more detail, the switching states of the relays 85 shown in FIG. 8 are taken to be those adopted when the photocells 48, 65 are fully illuminated. It will be noted in particular that the relay 85 associated with cell 48 is in the open-circuit condition, whereas the relay associated with photocell 65, used to sense the presence of trailing edges of articles in the duct 59, is closed. Thus, emplacement of the leading edge of an article on the closure member 21 actuates its associated photocell 48 to close its associated relay contacts. This will energize solenoid valve 86 to cause the ram 46 to retract. This will, however, be inhibited if the photocell 65 senses an article in the duct 59, in which case it will actuate its associated relay contacts to an open circuit condition preventing energization of solenoid valve 86. As soon as the article has passed photocell 65, the switching state of its associated relay 85 will be actuated to a closure condition, permitting solenoid 48 to actuate the solenoid valve 86.

When used in combination with the movable closure member loading system described above, individual multi-lane feeding may be achieved without the necessity of using removable partition walls between the inlets of the various stations. This is possible because immediately upon opening of the closure members the leading portion of the article is rapidly transferred to the feed end of the conveyor and the remainder is rapidly transferred by air flow into the streaming chamber. Thus, the entire article is quickly installed within elements of the suction system, and the closure members may be rapidly returned to the sealed position. Local suction loss in the vicinity of the closure members is thus quickly restored without requiring barriers therebetween where different small articles are fed to the machine at different points along the width of the inlet. The machine of the present invention is thus configurable to individual or collective lane feed by purely electrical means interconnecting the control circuitry for the various individual closure member actuators. Removable partitions are unnecessary.

Figure 13:
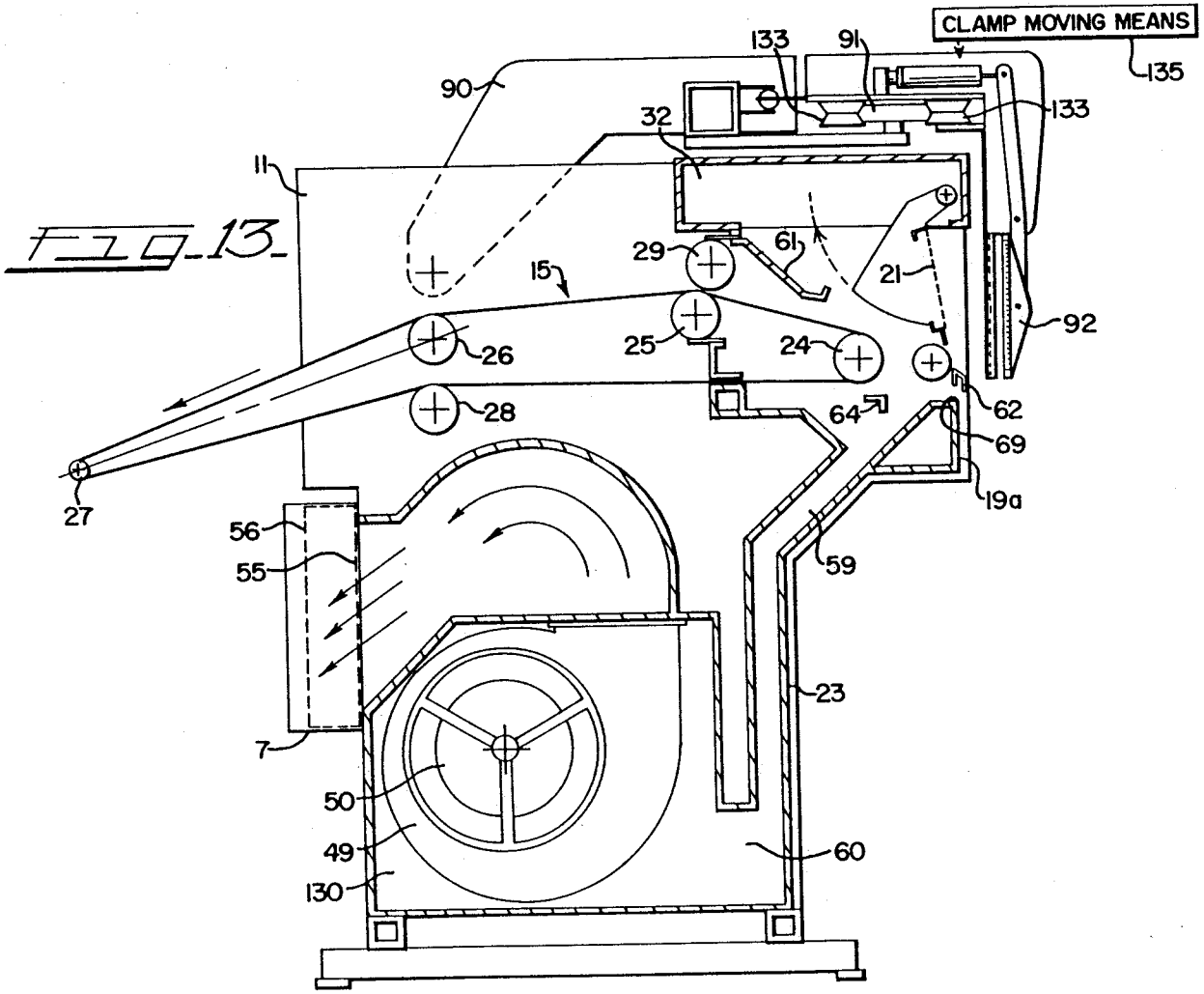
FIG. 13 is a similar view to FIG. 5 with a sheet clamping mechanism applied.
Figure 14:
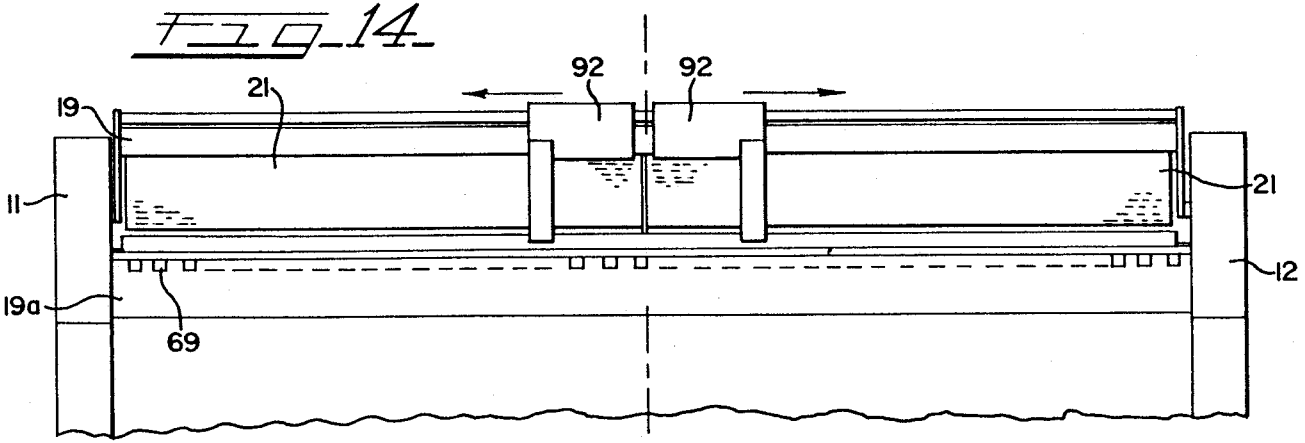
FIGS. 14 and 15 show front views of the mechanism with different arrangements of clamping mechanism applied.
Figure 15:
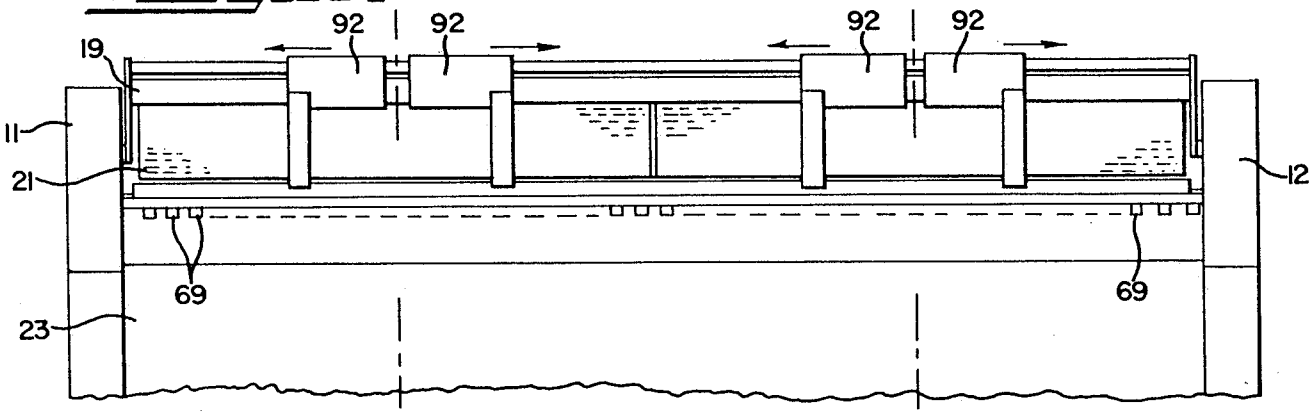

A modification to the above described feed mechanism is illustrated in FIG. 13 of the drawings in which a pair of arms 90 are mounted at the top of the mechanism on the side members 11, 12 towards the rear thereof and extend forwardly over the top of the enclosure. The arms carry a guide way 91 on which one or more pairs of ram operated sheet clamps 92 are movably mounted on diabolo wheels 133 engaging the guideway for movement by clamp moving means 135 and extending down the front wall of the enclosure. The arrangement of supporting and operation of the sheet clamps may be, for example, as described and illustrated in U.S. Pat. No. 4,378,645, issued Apr. 5, 1983. The clamps may move from a receiving station in which they lie adjacent to one another to receive the corners of a sheet placed by an operator and then move automatically apart to spread the sheet along the front of the enclosure adjacent the closure member 21. When they reach the spread position, the clamps are arranged to open automatically allowing the sheet to be drawn onto the closure member by the suction in the ports of the closure member as described earlier. Operation of the apparatus then continues as before. The clamps then move together to receive the next sheet. FIG. 14 illustrates a pair of such clamps applied to a feed mechanism and FIG. 15 illustrates two pairs of such clamps 92 applied to the feed mechanism to feed two separate lanes of the feed mechanism. The arm mounting 90 for the clamps 92 is arranged to allow the clamps to be pivoted upwardly away from the front of the enclosure when not required.

Figure 16:
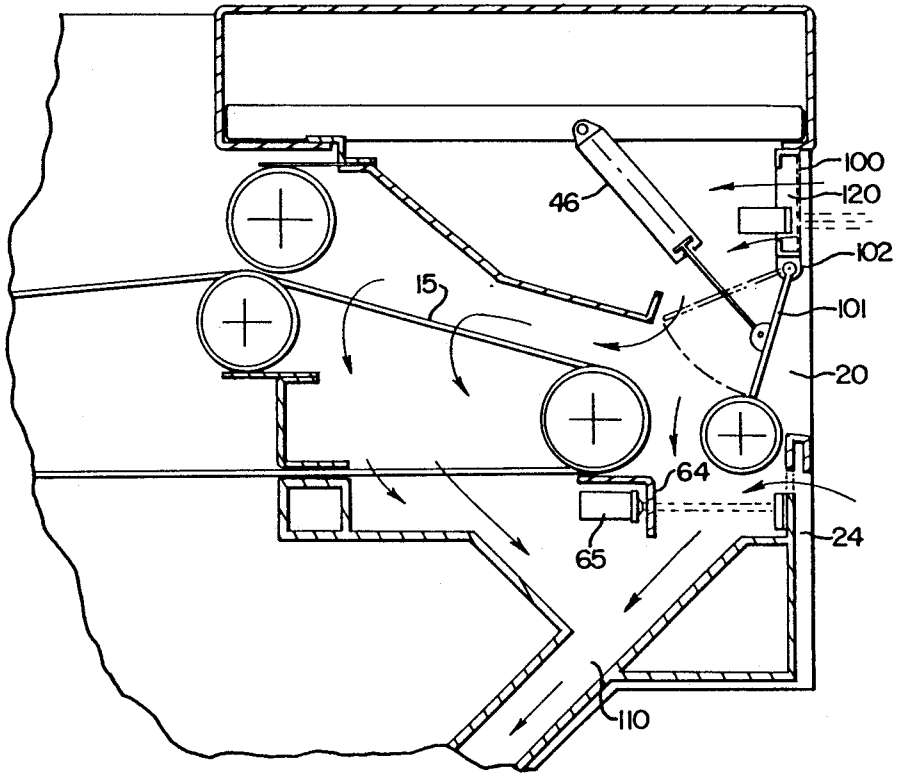
FIG. 16 is a further similar view to FIG. 5 showing a modified construction.

FIG. 16 of the drawings shows a further modification in which each inlet 20 has an upper fixed section 100 provided with a multiplicity of apertures 120 to provide suction ports for receiving and holding an upper part of a sheet to be fed through the mechanism. A small plate 101 is attached by a hinge 102 along the lower edge of the fixed section to open and close the inlet by means of a pneumatic ram 46 as described earlier. In this cases the leading part of the sheet does not adhere to the plate 101, but the low pressure region of the enclosure to which the sheet is exposed when the plate 101 is in the open position is sufficient to draw the leading edge of the sheet into the enclosure and onto the front end of the conveyor as before. The arrangement otherwise operates as described previously.

Figure 17:
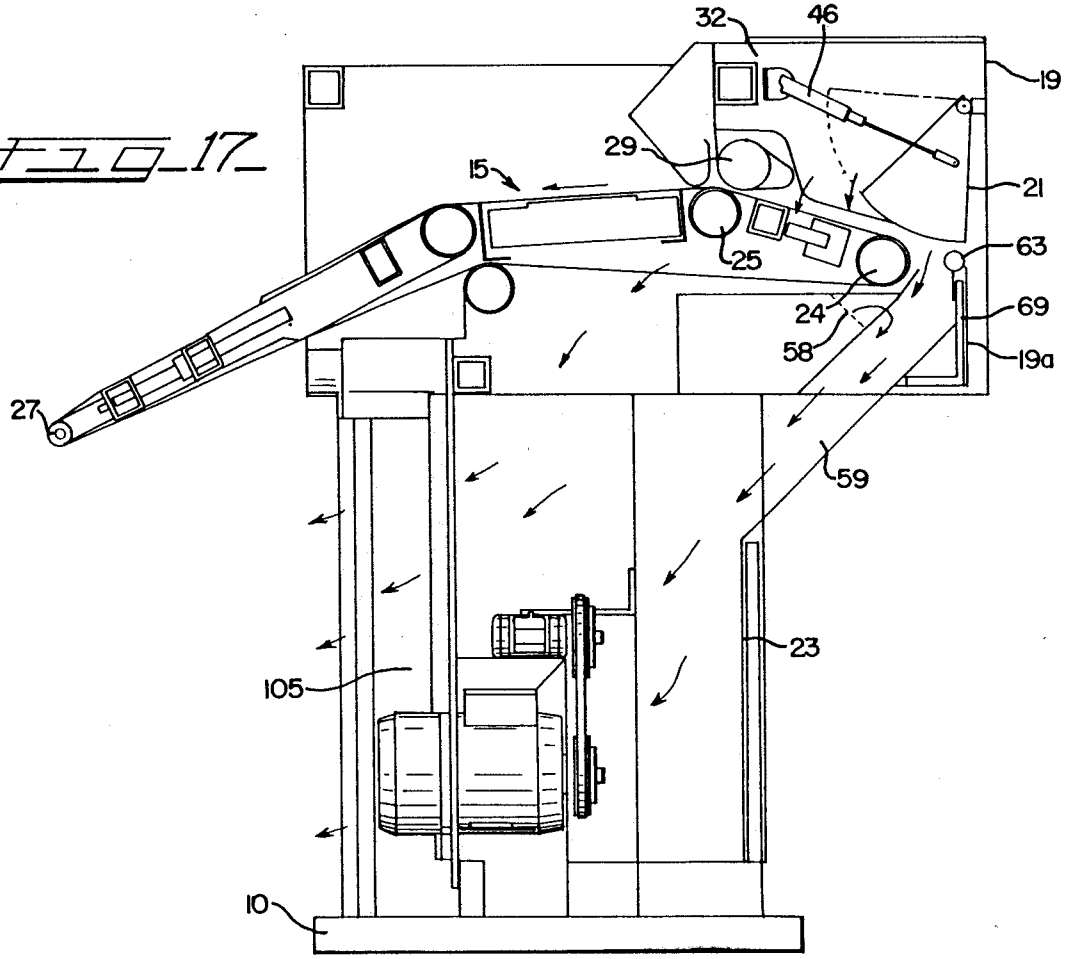
FIG. 17 is a further similar view to FIG. 5 showing a further modified arrangement.

FIG. 17 of the drawings illustrates a further variant in which axial fans 105 are utilized instead of the centrifugal fans of the previously described embodiment and air is drawn from a wider region beneath the conveyor into the chamber below the enclosure and is not concentrated in a duct adjacent the front of the enclosure as in the earlier described embodiments.

Figure 18:
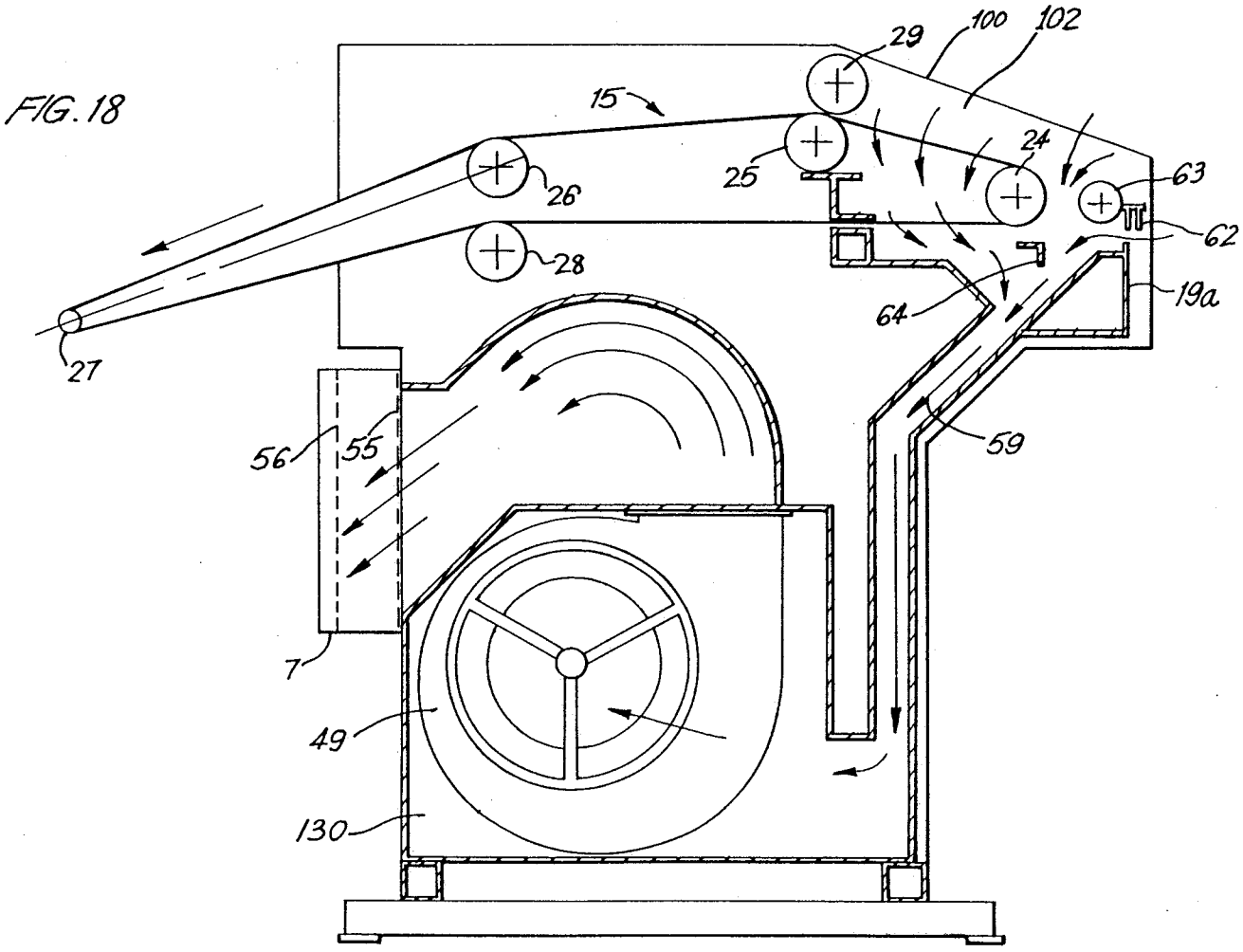
FIG. 18 is a view similar to FIG. 5 showing a machine configured for manual lay-in of articles on the conveyor system.

FIG. 18 shows in schematic form a cross section view of a simplified version of the machine shown in FIG. 5, this machine being configured for manual lay-in articles. A large generally open loading passage 102 defined between side plates 100 exposes the feed end of the conveyor so that articles may be laid directly thereon with the trailing ends draped thereover the smoothing edge 62. The air flow in the region of the feed end of the conveyor and between the rollers 24, 63 is as previously described.

While the invention has been described with reference to a preferred embodiment, it will be understood by those skilled in the art that various changes and modifications may be made and equivalents may be substituted for elements thereof without departing from the broader aspects of the invention and the scope of protection is only limited by the scope of the accompanying claims.

I claim:

1. A feed mechanism for laundry articles comprising:

conveyor means having a feed end to receive articles onto said conveyor means and a delivery end for delivering articles to further laundry equipment;

an enclosure for the feed end of said conveyor means extending over said feed end of said conveyor means, said enclosure having an enclosure inlet opening onto said feed end of said conveyor means and an outlet for dispensing said articles when carried by said conveyor means;

closure means for closing said enclosure inlet;

holding means for releasably holding an upper portion of one of said articles suspended in front of said enclosure inlet;

actuating means for retracting said closure means from said enclosure inlet and for restoring said closure means to a closing condition; and evacuating means for evacuating air from said enclosure below said conveyor means and disposed to create an air flow into said enclosure inlet so that retraction of said closure means causes the upper part of an article to be drawn into said enclosure and onto said conveyor means so that said article is drawn through said enclosure and to said delivery end of said conveyor means.

2. A feed mechanism as claimed in claim 1 including conveyor air passage means for permitting air to flow through said conveyor means.

3. A feed mechanism as claimed in claim 2, wherein said enclosure has air duct means extending along the width of said conveyor means below said feed end thereof and having a mouth located immediately below said feed end of said conveyor means and a duct portion extending generally downwardly from said mouth and to which said air evacuating means are connected to evacuate air from said enclosure so that as a leading part of an article is located on said conveyor means, said trailing part is drawn by said air flow into said duct means and is then extracted from said duct means as said conveyor means advances said article, said mouth being disposed so that air supplied through said conveyor air passage means provides an air flow into said duct portion along one trailing major surface of said article and air supplied from regions upstream of said conveyor means at said feed end provides an air flow into said duct portion along the opposite trailing major surface of said article, so that air flow through said duct means assists in drawing out and smoothing said article as it is drawn onto said conveyor means.

4. The feed mechanism of claim 3 wherein said mouth is inwardly convergent and said duct portion is configured with closely spaced opposing major walls to streamingly accept said articles.

5. A feed mechanism as claimed in claim 3, wherein said mouth of said duct means is located immediately below said enclosure inlet, said mechanism including at least one roller means mounted along the lower edge of said inlet adjacent said mouth over which an article passes as it enters said enclosure, and roller drive means for rotating said roller means so that the upper periphery of said roller means moves in a direction into said enclosure to assist in feeding said trailing part of said article into said enclosure and downwardly into said mouth of said duct means.

6. A feed mechanism as claimed in claim 5, wherein said closure means comprises at least one vertically disposed ported plate having upper and lower edges and hingemounted at said upper edge for inward movement into said enclosure and to which said leading part of said article is to be adhered, and sealing means for providing a suction seal between the lower edge of said plate and said roller means.

7. A feed mechanism as claimed in claim 5, including first smoothing means mounted along the outer side of said enclosure immediately below said roller means and over which said trailing part of said article is drawn as it passes into said enclosure inlet to assist in smoothing said article.

8. A feed mechanism as claimed in claim 7, including second smoothing means mounted immediately below the forward extremity of said conveyor means and extending at least partway across said mouth of said duct means and over which siad trailing part of said article is drawn as it is extracted from said duct means so as to ensure air flow over opposite faces of said article in said duct and to assist further in smoothing said article as it is drawn from said duct means onto said conveyor means.

9. A feed mechanism as claimed in claim 8, wherein said fan means includes at least one dual inlet centrifugal fan.

10. A feed mechanism as claimed in claim 3, wherein said evacuation means includes a chamber having chamber inlet means to which said duct portion is connected and chamber outlet means for ejecting air, and fan means disposed within said chamber for drawing air from said duct portion and delivering it to said chamber outlet means.

11. A feed mechanism as claimed in claim 10, wherein said fan means includes at least one axial flow fan.

12. A feed mechanism as claimed in claim 10, including a plurality of spaced apertured screens disposed in said chamber outlet means to disperse the stream of air output from said fan means to atmosphere.

13. A feed mechanism as claimed in claim 1, wherein said enclosure includes a generally upright front wall extending along and adjacent to said feed end of said conveyor means and said enclosure inlet is formed in said front wall to extend along said front wall the width of said feed end of said conveyor means.

14. A feed mechanism as claimed in claim 3, wherein said means for holding an article suspended against said enclosure inlet of said enclosure includes upper aperture means passing through one of said closure means and a portion of said front wall above said enclosure inlet and in communication with regions of low pressure created by said air evacuating means to cause said article to be held against said front wall when said enclosure inlet of said front wall is closed.

15. A feed mechanism as claimed in claim 14 including control means for controllingly operating said actuating means, said control means including first detecting means responsive to the presence of a leading end of an article adjacent the outer side of said closure means for causing said closure means to open and allow transfer of said leading end of said article onto said feed end of said conveyor means and for returning said closure means to said closed position thereafter and second detecting means responsive to the position of the trailing edge an article moved by said conveyor means for inhibiting subsequent opening of said closure means until said trailing edge has advanced a given distance.

16. A feed mechanism as claimed in claim 15, wherein said first and second detecting means include photoelectric sensing means.

17. A feed mechanism as claimed in claim 15 or claim 16 wherein said enclosure means comprises at least one vertically disposed ported plate having upper and lower edges and hinge-mounted at said upper edge for inward movement into said enclosure and to which said leading part of said article is to be adhered, and said first detecting means are mounted on said ported plate at a predetermined distance above the bottom edge of said plate so as to ensure that a sufficient length of said article is laid on said closure means for transfer of said leading part of said article to said conveyor means.

18. A feed mechanism as claimed in claim 15 or claim 16, wherein said front wall of said enclosure has ports formed above said inlet to which said leading part of said article is to be adhered by air evacuated from within said enclosure,.and said first detecting means are positioned in said enclosure adjacent said front wall at a predetermined position above said to ensure that a sufficient length of article is laid on said front wall transfer of said leading part of to said conveyor means.

19. A feed mechanism as claimed in claim 14, wherein said upper aperture means are formed in said closure means so that an upper part of said article can be held to said closure means when said closure means closes said enclosure inlet and is drawn into said enclosure to be transferred to said feed end of said conveyor means by retraction of said closure means into said enclosure.

20. A feed mechanism as claimed in claim 14, wherein said upper aperture means are ports formed in a part of said front wall of said enclosure above said closure means to suspend an upper portion of said laundry article across said enclosure inlet and disposed so that opening of said closure means allows air drawn into said enclosure by said evacuating means to draw said upper part of said article into said enclosure and adheringly onto said forward end of said conveyor means to draw the remainder of said article be drawn through said enclosure and to said delivery end of said conveyor means.

21. The feed mechanism as claimed in claim 19, including hinge mounting means for attaching said closure means at a top edge thereof to said front wall.

22. A feed mechanism as claimed in claims 19 or 20, wherein said holding means comprises clamp means mounted on said enclosure to receive and support corners of said article to hold said article spread along said enclosure inlet.

23. A feed mechanism as claimed in claim 22, including guideway means extending along said enclosure and upon which said clamp means are mounted, and moving means for moving said clamp means between adjacent positions to receive an article and spaced positions to spread said article for entry to said enclosure.

24. A feed mechanism as claimed in claim 3, including lower aperture means disposed on said enclosure front wall immediately below said enclosure inlet and through which air is drawn by the evacuating means to provide suction ports for assisting in holding an article suspended across said enclosure inlet prior to being drawn into said enclosure.

25. A feed mechanism as claimed in claims 1 or 3, wherein said conveyor means a multiplicity of parallel spaced apertured flexible bands through air can be drawn for receiving and carrying said articles through said enclosure.

26. A feed mechanism as claimed in claims 1 or 10 wherein said closure means includes a plurality of closure members disposed along said enclosure inlet in side-by-side arrangement, individually operable actuating means for selectively opening and closing each said closure member, collective control means for selectively coupling one or more adjacent closure members to open and close collectively, and individual control means for decoupling said closure members to operate individually, so that said feed mechanism can be configured to provide a single relatively wide path for feeding wide articles or to provide a plurality of lanes along which narrower articles can be fed.

27. A feed mechanism as claimed in claims 1 or 3, wherein said evacuating means are continuously operable means.

28. A feed mechanism as claimed in claims 1 or 10 wherein said actuating means for retracting and returning said closure means comprise pneumatic ram means mounted in said enclosure and connected to said closure means.

29. A feed mechanism as claimed in claims 1 or 3 wherein said closure means comprises at least one vertically disposed ported plate having upper and lower edges and hingemounted at said upper edge for inward movement into said enclosure and to which said leading part of said article is to be adhered.

30. A feed mechanism as claimed in claim 29 including limit stop means for arresting said inward movement of said plate at an orientation to assist in directing the airflow entering said enclosure downward and generally about said conveyor means feed end.

31. A feed mechanism as claimed in claims 1 or 3 wherein said conveyor means includes one or more endless belt means extending between said feed end and said delivery end and having upper and lower belt runs and including a plurality of belt-engaging rollers, said enclosure includes side and top walls and rear wall means generally confronting said inlet, said feed mechanism including sealing means for sealing against ingress of air from said rear wall means, said sealing means including first and second oppositely disposed rollers contacting upper and lower surfaces of said belt run respectively and disposed intermediate said rear wall means and said delivery end, flexible sealing members sealingly joining the surfaces of said first and second rollers with said rear wall means, and slot passage means in said rear wall means disposed about said lower belt run.

32. A feed mechanism for laundry articles comprising:

conveyor means having a front feed end to receive articles onto said conveyor means and a rear delivery end for delivering articles to further laundry equipment;

conveyor air passage means for permitting air to flow through said conveyor means;

evacuating means for evacuating air;

air duct means extending along the width of said conveyor means and having an entry mouth located below said feed end of said conveyor means and a duct portion extending generally downwardly from said mouth and to which said air evacuating means are connected, said mouth having one side disposed to extend under a terminal portion of said feed end and an opposite side disposed to extending under a flow region in front of said feed end so that as a leading part of an article is located on said conveyor means it is adhered thereto by suction and its associated trailing part is drawn by the air flow from said flow region into said duct portion to be entrailed therein and is then extracted from said duct means as said conveyor means advances said article, said mouth being disposed so that during said extraction air supplied through said conveyor air passage means provides an air flow into said duct portion along one trailing major surface of said article and air supplied from said flow region provides an air flow into said duct portion along the opposite trailing major surface of said article to assist in drawing out and smoothing said article.

33. The feed mechanism of claim 32 wherein said mouth is inwardly convergent.

34. The feed mechanism of claims 32 or 33 wherein said duct portion is configured with closely spaced opposing major walls to streamingly accept said articles.

35. A feed mechanism as claimed in claim 32, including feed support means having a feed support surface spaced from and adjacent to said feed end over which articles are moved onto said conveyor means, said feed support surface including at least one roller means over which an article passes as it enters said enclosure, said mechanism including roller drive means for rotating said roller means so that eh upper periphery of said roller means moves in a direction to assist in feeding said trailing part of said article downwardly into said mouth of said duct means.

36. A feed mechanism as claimed in claim 34, including first smoothing means mounted along the outer side of said enclosure immediately below said roller means and over which said trailing part of said article is drawn as it passes into said enclosure inlet to assist in smoothing said article.

37. A feed mechanism as claimed in claim 36, including second smoothing means mounted immediately below the forward extremity of said conveyor means and extending at least partway across said mouth of said duct means and over which said trailing part of said article is drawn as it is extracted from said duct means so as to ensure air flow over both major faces of said article in said duct and to assist further in smoothing said article as it is drawn from said duct means onto said conveyor means.

38. A feed mechanism as claimed in claim 37, wherein said fan means includes at least one dual inlet centrifugal fan.

39. A feed mechanism as claimed in claim 32, wherein said evacuation means includes a chamber having chamber inlet means to which said duct portion is connected and chamber outlet means for ejecting air, and fan means disposed within said chamber for drawing air from said duct portion and delivering it to said chamber outlet means.

40. A feed mechanism as claimed in claim 39, wherein said fan means includes at least one axial flow fan.

41. A feed mechanism as claimed in claim 39, including plurality of spaced apertured screens disposed in said chamber outlet means to disperse the stream of air output from said fan means to atmosphere.

42. A feed mechanism as claimed in claim 32, wherein said conveyor means comprises a multiplicity of parallel spaced apertured flexible bands through which air can be drawn for receiving and carrying said articles through said enclosure.

* * * * *

UNITED STATES PATENT AND TRADEMARK OFFICE

CERTIFICATE OF CORRECTION

PATENT NO. : 4,967,495

DATED : November 6, 1990

INVENTOR(S) : Henry J. Weir

It is certified that error appears in the above-identified patent and that said Letters Patent is hereby corrected as shown below:

Column 1, line 36, "sued" should be --used--.

line 61, "t" should be --to--.

Column 5, line 32, "30" should be --130--.

Column 7, line 12, after "lower" insert --edge--.

line 13, after "a" insert --brush--.

line 14, replace "sea" by --seal and--; after "closure" insert --member--.

Column 10, line 63, "siad" should be --said--.

Column 11, line 23, the claim reference numeral "3" should be --13--.

line 50, "enclosure" should read --closure--.

line 66, after "said" insert --inlet--.

line 67, after "of" insert --said--; after "wall" insert --for--.

line 68, after "of" insert --said article--.

Column 12, line 34, the claim reference number "3" should read --13--.

line 42, after "means" insert --comprises--.

line 43, after "through" insert --which--.

UNITED STATES PATENT AND TRADEMARK OFFICE

CERTIFICATE OF CORRECTION

PATENT NO. : 4,967,495

DATED : November 6, 1990

INVENTOR(S) : Henry J. Weir

It is certified that error appears in the above-identified patent and that said Letters Patent is hereby corrected as shown below:

Column 12, line 46, the claim reference numeral "10" should read --3--.

line 62, the claim reference numeral "10" should read --3--.

Column 13, line 44, replace "tending" by --tend--.

Column 14, line 16, replace "eh" by --the--.

line 20, the claim reference numeral "34" should read --35--.

line 36, the claim reference numeral "37" should read --39--.

Signed and Sealed this

Eleventh Day of May, 1993

*Attest:*

Michael K. Kirk

MICHAEL K. KIRK

*Attesting Officer*

*Acting Commissioner of Patents and Trademarks*